US009081313B2

(12) United States Patent
Nebashi et al.

(10) Patent No.: US 9,081,313 B2
(45) Date of Patent: Jul. 14, 2015

(54) ELECTROPHOTOGRAPHIC PHOTOCONDUCTOR, PRODUCTION METHOD THEREOF, AND ELECTROPHOTOGRAPHIC DEVICE

(75) Inventors: Kazuki Nebashi, Matsumoto (JP); Shinjiro Suzuki, Matsumoto (JP); Seizo Kitagawa, Matsumoto (JP)

(73) Assignee: FUJI ELECTRIC CO., LTD., Kawasaki-shi (JP)

( * ) Notice: Subject to any disclaimer, the term of this patent is extended or adjusted under 35 U.S.C. 154(b) by 0 days.

(21) Appl. No.: 13/985,037

(22) PCT Filed: Feb. 14, 2012

(86) PCT No.: PCT/JP2012/053410
§ 371 (c)(1),
(2), (4) Date: Aug. 12, 2013

(87) PCT Pub. No.: WO2012/111672
PCT Pub. Date: Aug. 23, 2012

(65) Prior Publication Data

US 2013/0316276 A1 Nov. 28, 2013

(30) Foreign Application Priority Data

Feb. 15, 2011 (WO) ..... PCT/JP2011/053186

(51) Int. Cl.
*G03G 15/02* (2006.01)
*G03G 15/04* (2006.01)
(Continued)

(52) U.S. Cl.
CPC ..... *G03G 5/071* (2013.01); *G03G 5/0542* (2013.01); *G03G 5/0589* (2013.01); *G03G 5/0696* (2013.01)

(58) Field of Classification Search
USPC ..... 430/59.2, 59.4, 60, 69, 96
See application file for complete search history.

(56) References Cited

U.S. PATENT DOCUMENTS 5,834,146 A * 11/1998 Hoshizaki et al. ..... 430/58.5
5,874,570 A * 2/1999 Tamura et al. ..... 540/141
(Continued)

FOREIGN PATENT DOCUMENTS

JP S58-030757 2/1983
JP S58-105154 6/1983
JP S62-095537 5/1987
JP S62-160455 7/1987
JP H02-008256 1/1990
JP H03-023462 1/1991
(Continued)

*Primary Examiner* — Thorl Chea
(74) *Attorney, Agent, or Firm* — Rabin & Berdo, P.C.

(57) ABSTRACT

An electrophotographic photoconductor including, in the order recited: a conductive substrate; an undercoat layer provided on the conductive substrate; and a photoconductive layer provided on the undercoat layer and containing at least a phthalocyanine compound as a charge generation material and, as a resin binder, a polyvinyl acetal resin composed of a repeating unit represented by formula (1):

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 86 to 99 mol %; and a molar ratio (x:z) of the structural units is 95:5 to 50:50.

9 Claims, 4 Drawing Sheets

(51) Int. Cl.

| | |
|---|---|
| ***G03G 5/07*** | (2006.01) |
| ***G03G 5/05*** | (2006.01) |
| ***G03G 5/06*** | (2006.01) |

(56) References Cited

U.S. PATENT DOCUMENTS

| | | | |
|---|---|---|---|
| 6,210,847 | B1 | 4/2001 | Miyauchi et al. |
| 6,555,617 | B1 | 4/2003 | Tanaka et al. |

FOREIGN PATENT DOCUMENTS

| | | | |
|---|---|---|---|
| JP | H05-001108 | | 1/1993 |
| JP | H09-265202 | | 10/1997 |
| JP | 2000-129155 | A | 5/2000 |
| JP | 2001-105546 | A | 4/2001 |
| JP | 2006-133701 | A | 5/2006 |
| JP | 2010-164945 | A | 7/2010 |

* cited by examiner

ELECTROPHOTOGRAPHIC PHOTOCONDUCTOR, PRODUCTION METHOD THEREOF, AND ELECTROPHOTOGRAPHIC DEVICE

BACKGROUND OF THE INVENTION

1. Field of the Invention

The present invention relates to an electrophotographic photoconductor (hereafter also referred to simply as "photoconductor") which has a photoconductive layer containing an organic material and which is used in electrophotographic printers, copiers, fax machines and the like, to a method for producing the electrophotographic photoconductor, and to an electrophotographic device. In particular, the invention relates to a multilayer-type or single-layer-type electrophotographic photoconductor having excellent image characteristics and electric characteristics, through improvement of a resin binder that is a constituent material of a photoconductive layer, to a method for producing the electrophotographic photoconductor, and to an electrophotographic device.

2. Description of the Related Art

The various functions that are required of electrophotographic photoconductors include, ordinarily, a function of holding surface charge, in the dark, a function of generating charge through reception of light, and a function of transporting charge likewise through reception of light. Such electrophotographic photoconductors include so-called multilayer-type photoconductors having a stack of layers functionally separated into a layer that contributes mainly to charge generation, and a layer that contributes to holding surface charge, in the dark, and to charge transport upon light reception, and so-called single-layer-type photoconductors wherein these functions are combined in one layer.

For instance, the Carlson method is used in image formation by an electrophotographic method that utilizes such electrophotographic photoconductors. Image formation according to this scheme involves charging a photoconductor in the dark, forming a electrostatic latent image corresponding to text, pictures or the like of an original, on the charged photoconductor surface, through exposure, developing the formed electrostatic latent image by means of toner, and transferring and fixing the developed toner image onto a support such as paper. The photoconductor after toner image transfer undergoes, for instance, removal of residual toner and removal of charge, and is thereafter re-used.

Materials used as the above-described electrophotographic photoconductor include inorganic photoconductive materials such as selenium, selenium alloys, zinc oxide and cadmium sulfide. In electrophotographic photoconductors that have been brought to practical use in recent years, a photoconductive layer is formed by dispersing, in a resin binder, an organic photoconductive material, which is advantageous in terms of thermal stability, film-forming properties and so forth, in comparison to inorganic photoconductive materials. Examples of such organic photoconductive materials include, for instance, poly-N-vinyl carbazole, 9,10-anthracenediol polyester, pyrazoline, hydrazone, stilbene, butadiene, benzidine, phthalocyanines and bisazo compounds.

In recent years, the above-described functional separation multilayer-type photoconductors, having formed therein a photoconductive layer that is a stack of a charge generation layer containing a charge generation material and a charge transport layer containing a charge transport material, have entered the mainstream thanks to the large degree of design freedom that these photoconductors afford, by virtue of the broad selection of materials, from among a wealth of organic materials, that are suited for the various functions of the photoconductive layer.

From among the foregoing photoconductors, numerous products have been made out of negative charging-type photoconductors having a charge generation layer in the form of a conductive substrate on which there is formed a layer of an organic photoconductive material, by vapor deposition, or a layer that is formed by dip coating in a coating solution having an organic photoconductive material dispersed in a resin binder, the photoconductor having, on the charge generation layer, a charge transport layer in the form of a layer that is formed by dip coating using a coating solution resulting from dispersing or dissolving, in a resin binder, an organic low-molecular compound having a charge transport function.

Positive charging-type photoconductors that rely on a single photoconductive layer formed by dispersing or dissolving a charge generation material and a charge transport material in a resin binder are likewise well known.

Electrophotographic printing devices are required to possess, among others, ever higher durability and sensitivity, and faster response, to cope with, for instance, increases in the number of copies to be printed in a networked office, and to cope with the rapid development of lightweight electrophotographic printing machines. These devices, moreover, are held to strict requirements in terms of exhibiting little fluctuation in image characteristics and electric characteristics that arise from repeated use and from variations in the usage environment (room temperature, humidity).

The development and growing spread of color printers in recent times have been accompanied by greater printing speeds, smaller devices, fewer components, and the need to cope with a variety of usage environments. In color printers, a tendency is observed wherein transfer current increases on account of toner color overlap and/or the use of transfer belts. When printing on paper of various sizes, a difference in transfer fatigue arises between portions with paper and portions without paper. This in turn exacerbates differences in image density, which is problematic. In case of frequent printing on small-sized paper, bare photoconductor portions over which the paper does not pass (paper non-passage sections) are continuously and directly affected by transfer, and exhibit greater transfer fatigue than photoconductor portions over which paper does pass (paper passage sections). As a result, when printing is performed next on large-size paper, the abovementioned discrepancy in transfer fatigue between paper passage sections and paper non-passage sections gives rise to a potential difference in the developed area, which translates into differences in density. This trend becomes yet more pronounced as transfer current increases. Under such circumstances, the demand has intensified for photoconductors that exhibit little fluctuation in image characteristics and electric characteristics as a result of repeated use, or on account of fluctuations in the usage environment (room temperature and environment), and that exhibit excellent transfer resiliency, particularly in color printer, as compared to monochrome printers. However, conventional technologies have thus far failed to meet these requirements simultaneously to a sufficient degree.

As described above, the charge generation layer is ordinarily formed as a layer that comprises a dispersion of a charge generation material in the form of an organic photoconductive material, such as a phthalocyanine compound, in a resin binder. Various types of resins have been considered as such a resin binder.

For instance, polyvinyl acetal resins and polyvinyl butyral resins exhibit good pigment dispersibility in the coating solution during the production of the photoconductor, and are excellent in adhesiveness, as disclosed in Patent Document 1 (Japanese Patent Application Publication No. S62-95537) and Patent Document 2 (Japanese Patent Application Publication No. S58-105154). The synthesis method of polyvinyl acetal resins themselves has also been the object of study, as disclosed in Patent Document 3 (Japanese Patent Application Publication No. H5-1108).

Patent Document 4 (Japanese Patent Application Publication No. 2006-133701) studies a charge generation layer that contains, in specific mixing ratios, two polyvinyl butyral resins having dissimilar degrees of butyralization, and two polyvinyl butyral resins having dissimilar contents of hydroxyl groups. The charge generation layer is found to be effective in improving repeat stability and sensitivity under high-temperature, high-humidity environments, but the transfer resistance of the charge generation layer is not addressed.

Also known are technologies for enhancing sensitivity, repeat durability and liquid storage stability by, for instance, combining a polyamide, as a binder for an undercoat layer binder, with a polyvinyl butyral resin, as a binder for a charge generation layer (Patent Document 5, Japanese Patent Application Publication No. S58-30757), or combining a copolymer nylon, as a binder for an undercoat layer, with a polyvinyl butyral resin, as a binder for a charge generation layer (Patent Document 6, Japanese Patent Application Publication No. H9-265202). Transfer resistance, however, is not addressed. Patent Document 7 (Japanese Patent Application Publication No. 2001-105546) discloses a laminate that comprises a base material layer and a layer of a curable resin composition that comprises a specific modified polyvinyl acetal resin, and discloses a specific example relating to a polyvinyl acetal resin comprising phenyl groups (butyl groups:phenyl groups=19:59), but the laminate does not pertain to a photoconductor.

As described above, polyvinyl acetal resins including polyvinyl butyral resins are known constituent materials in photoconductive layers of electrophotographic photoconductors, and methods for producing and using these resins have been the object of various studies. However, none of those studies has succeeded thus far in sufficiently satisfying all from among high transfer resistance, high memory characteristics and good electric characteristics.

Accordingly, it is an object of the present invention to solve the above issues and to provide an electrophotographic photoconductor having high transfer resistance, high memory characteristics and good electric characteristics, to provide a production method of the electrophotographic photoconductor, and to provide an electrophotographic device.

SUMMARY OF THE INVENTION

As a result of diligent research, the inventors found that the above problems could be solved by using, in a photoconductive layer, a polyvinyl acetal resin that contains phenyl groups as constituent monomers, and in particular, by using, in a photoconductive layer, a polyvinyl acetal resin that contains such phenyl group-containing units in specific ratios, and perfected the present invention on the basis of that finding.

Specifically, the electrophotographic photoconductor of the present invention is an electrophotographic photoconductor, comprising, in the order recited: a conductive substrate; an undercoat layer provided on the conductive substrate; and a photoconductive layer provided on the undercoat layer and containing at least a phthalocyanine compound as a charge generation material and, as a resin binder, a polyvinyl acetal resin composed of a repeating unit represented by formula (1):

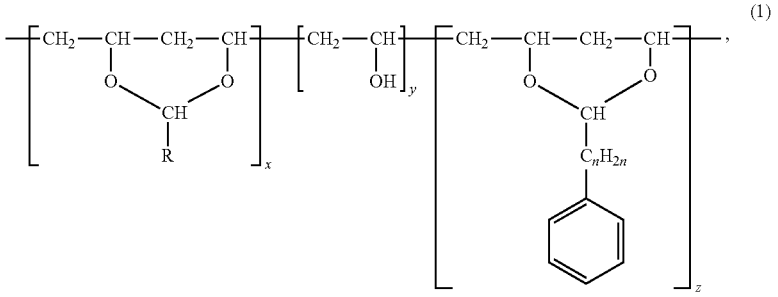

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 76 to 99 mol %; and a molar ratio (x:z) of the structural units is 95:5 to 50:50.

In the present invention, preferably, a polyvinyl butyral resin in which R in formula (1) is a propyl group is used as the resin binder.

In the present invention, Y-type oxotitanyl phthalocyanine may be preferably used as the phthalocyanine compound. In the present invention, preferably, the undercoat layer contains a polyamide resin.

In the present invention, preferably, the photoconductive layer is of a multilayer type including a charge generation layer and a charge transport layer, and contains, as a resin binder of the charge generation layer, 1 to 5 mass % of a vinyl chloride-based copolymer resin relative to total amount of the resin binder in the charge generation layer.

The electrophotographic photoconductor production method of the present invention is a method for producing an electrophotographic photoconductor as described above, comprising: providing a conductive substrate; providing an undercoat layer on the conductive substrate; providing a coating solution containing at least a phthalocyanine compound as a charge generation material, and, as a resin binder, a polyvinyl acetal resin composed of a repeating unit represented by formula (1):

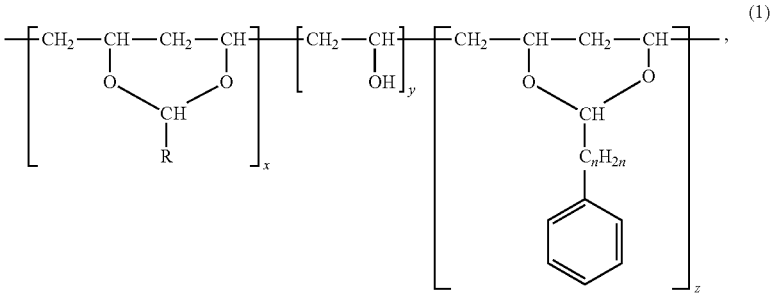

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 76 to 99 mol %; and a molar ratio (x:z) of the structural units is 95:5 to 50:50; and forming a photoconductive layer by applying the coating solution onto the undercoat layer.

The electrophotographic device of the present invention is equipped with the above-described electrophotographic photoconductor of the present invention.

By virtue of the above features, the present invention allows realizing an electrophotographic photoconductor having high transfer resistance, high memory characteristics and good electric characteristics, and realizing a production method of the electrophotographic photoconductor, and an electrophotographic device.

DETAILED DESCRIPTION OF THE INVENTION

Specific embodiments of the electrophotographic photoconductor according to the present invention will be explained in detail next with reference to accompanying drawings. The present invention is not limited in any way by the examples set forth below.

Figure 1:
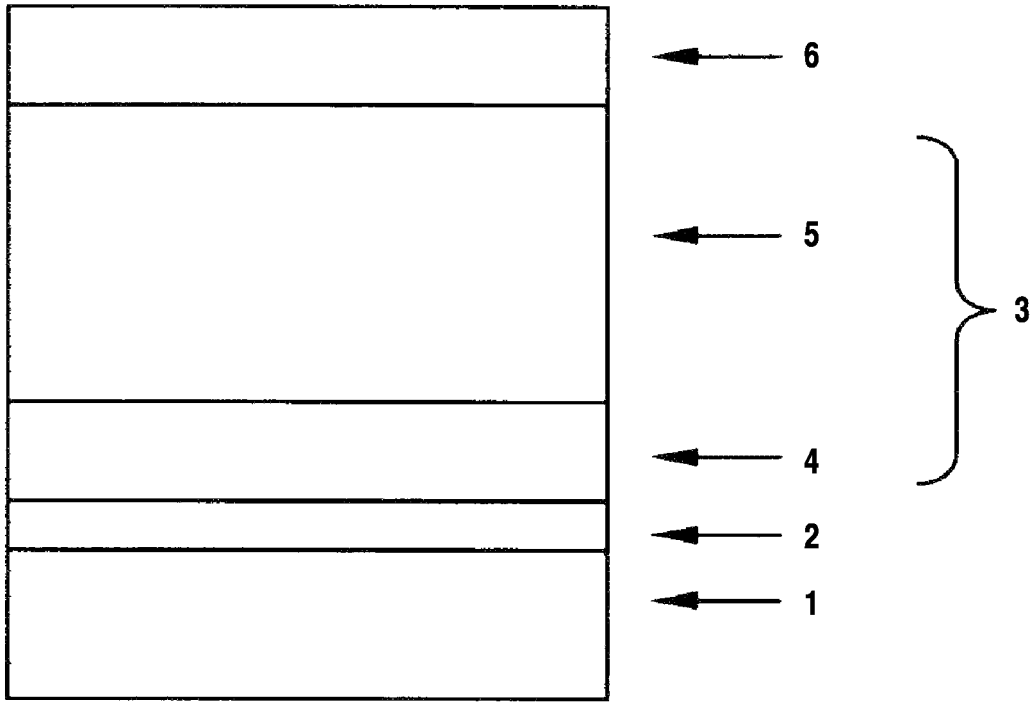
FIG. 1 is a schematic cross-sectional diagram illustrating a configuration example of a negative charging functional separation multilayer-type electrophotographic photoconductor as an example of the electrophotographic photoconductor of the present invention.

Electrophotographic photoconductors include negative charging multilayer-type photoconductors, positive charging single-layer-type photoconductors and positive charging multilayer-type photoconductors. As an example, FIG. 1 illustrates a schematic diagram cross-sectional diagram of a negative charging multilayer-type electrophotographic photoconductor. As illustrated in the figure, the negative charging multilayer-type photoconductor is obtained through sequential stacking of an undercoat layer 2, and a photoconductive layer 3 that comprises a charge generation layer 4 having a charge generation function and a charge transport layer 5 having a charge transport function, onto a conductive substrate 1. A surface protective layer 6 may be further provided on the photoconductive layer 3 in the photoconductors of all types.

The conductive substrate 1 functions as one electrode of the photoconductor, and, at the same time, constitutes a support of the various layers that make up the photoconductor. The conductive substrate 1 may be of any shape, for instance, cylindrical, plate-like or film-like, and the material thereof may be a metal such as aluminum, stainless steel, nickel or the like, or a material such as glass, a resin or the like the surface whereof has undergone a conductive treatment.

Ordinarily, the undercoat layer 2 comprises a layer having a resin as a main component, or a metal oxide coating film of alumite or the like, and is provided, as the case may require, in order to control the injectability of charge from the conductive substrate into the photoconductive layer, or for the purpose of, for instance, covering defects on a base surface, or enhancing adhesion between the photoconductive layer and an underlying member. Examples of the resin that is used in the undercoat layer include, for instance, acrylic resins, vinyl acetate resins, polyvinyl formal resins, polyurethane resins, polyamide resins, polyester resins, epoxy resins, melamine resins, polyvinyl butyral resins, polyvinyl acetal resins, vinylphenol resins and the like. These resins can be used singly or mixed with each other in appropriate combinations. Preferably, the undercoat layer 2 contains a polyamide resin, which is found to be advantageous in terms of transfer resistance. The undercoat layer 2 can contain, for instance, metal oxide microparticles of titanium oxide, tin oxide, zinc oxide, copper oxide or the like. The foregoing microparticles may be subjected to a surface treatment with an organic compound such as a siloxane compound, an alkoxysilane compound, a silane coupling agent or the like.

As described above, the charge generation layer 4 is formed in accordance with a method that involves, for instance, applying a coating solution in which particles of a charge generation material are dispersed in a resin binder. Charge is generated in the charge generation layer 4 through reception of light. The injectability of the generated charge into the charge transport layer 5, accompanied at the same time with high charge generation efficiency, is an important consideration. Preferably, electric-field dependence is low and injection is good also in low fields.

An important feature of the present invention is that the photoconductive layer 3 contains, as a resin binder, a polyvinyl acetal resin composed of a repeating unit represented by formula (1) below, and that the resin contains phenyl groups as constituent monomers:

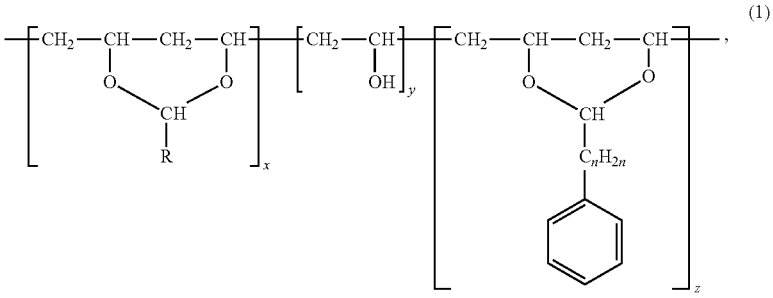

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 76 to 99 mol %; and a molar ratio (x:z) of the structural units is 95:5 to 50:50. In the case of a multilayer-type photoconductor, the charge generation layer 4 is set to contain the abovementioned specific resin binder. The desired effect of the present invention can be achieved by virtue of the above features, in conjunction with the feature of incorporating at least a phthalocyanine compound as the charge generation material in the photoconductive layer 3, as described below.

In the present invention, a polyvinyl butyral resin in which R in formula (1) is a propyl group is particularly preferably used as the resin binder.

The degree of acetalization (x+z) in formula (1) must range from 76 to 99 mol %, or 86 to 99 mol %, and is set preferably to range from 86 to 95 mol %, since it is found that a degree of acetalization (x+z) of 100 mol % gives rise to pigment flocculation and sedimentation when the resin binder is in solution. The molar ratio x:z of the structural units of formula (1) must satisfy the range 95:5 to 50:50, and more preferably the range 70:30 to 50:50, since this results in better transfer resistance.

In the present invention, it is essential that the resin binder represented by formula (1) above be used as the resin binder of the charge generation layer 4. Herein, polyvinyl acetate is used as the starting material of polyvinyl alcohol, which is in turn a starting material of such a binder. Upon synthesis of polyvinyl alcohol, however, residual acetyl groups ordinarily remain within the repeating units, in amounts ranging from trace amounts to several % in the synthesized polyvinyl alcohol. These acetyl groups may remain also in the resin binder. The present invention encompasses instances where the abovementioned resin binder comprises arbitrary components derived from such starting materials. The effect and characteristics of the present invention are not adversely affected by the presence of small amounts of such acetyl groups in the repeating units of the above resin binder. Examples of the resin binder of the charge generation layer 4 that can be used in the present invention, in appropriate combinations, include the abovementioned resin binders, and, in addition, polycarbonate resins, polyester resins, polyamide resins, polyurethane resins, vinyl chloride resins, vinyl acetate resins, phenoxy resins, polystyrene resins, polysulfone resins, diallyl phthalate resins, as well as polymers and copolymers of methacrylate resins. The combined content in a case where the binder represented by formula (1) is used concomitantly with other resins ranges from 10 to 90 mass %, preferably from 40 to 60 mass %, with respect to the solids of the charge generation layer 4. Preferably, a resin binder in the form of a vinyl chloride-based copolymer resin is present in an amount of 1 to 5 mass % relative to the total amount of the resin binder in the charge generation layer, since it is found that this is advantageous in terms of liquid stability.

In the present invention it is essential that the charge generation layer 4 comprises at least a phthalocyanine compound, as a charge generation material. Examples of phthalocyanine compounds that can be used include, for instance, various known metal phthalocyanines. Oxotitanyl phthalocyanines are preferred among the foregoing, and pronounced effects of improving sensitivity, image quality and transfer resistance are elicited when using an oxotitanyl phthalocyanine in the form of α-type oxotitanyl phthalocyanine, β-type oxotitanyl phthalocyanine or amorphous oxotitanyl phthalocyanine, and, in particular, Y-type oxotitanyl phthalocyanine or the oxotitanyl phthalocyanine exhibiting a maximum peak at a Bragg angle 28 of 9.6°, in a CuKα:X-ray diffraction spectrum, as set forth in the specification of Japanese Patent Application Publication No. H8-209023 or U.S. Pat. No. 5,874,570. The above-described oxotitanyl phthalocyanines of dissimilar crystal type can be used concomitantly. Other charge generation materials, such as various azo pigments, anthanthrone pigments, thiapyrylium pigments, perylene pigments, perinone pigments, squarylium pigments, quinacridone pigments and the like can be used concomitantly along with the phthalocyanine compound.

It is sufficient for the charge generation layer 4 to have a charge generation function, and hence the thickness of the charge generation layer 4 is determined depending on the light absorption coefficient of the charge generation material, and is ordinarily 1 μm or less, and preferably 0.5 μm or less. The content of the charge generation material ranges from 10 to 90 mass %, preferably from 40 to 60 mass %, with respect to the solids of the charge generation layer 4. The charge generation layer has a charge generation material as a main constituent, but a charge transporting material or the like can be also used as an additive.

The charge transport layer 5 is mainly made up of the charge transport material and a resin binder. As the charge transport material there can be used various hydrazone compounds, styryl compounds, diamine compounds, butadiene compounds, indole compounds or the like, singly or mixed with each other in appropriate combinations. Examples of the resin binder include, for instance, polycarbonate resins of bisphenol A-type, bisphenol Z-type, bisphenol A-type-biphenyl copolymers or the like, as well as polystyrene resins, polyphenylene resins or the like. The foregoing can be used singly or mixed with each other in appropriate combinations. The use amount of the charge transport material ranges from 2 to 50 parts by mass, and preferably 3 to 30 parts by mass, with respect to 100 parts by mass of the resin binder. The thickness of the charge transport layer ranges preferably from 3 to 50 μm, more preferably from 15 to 40 μm, in order to maintain an effective surface potential in practice.

Examples II-1 to II-5 of the charge transport material of the present invention are illustrated below, but the present invention is not limited to these examples.

II-1

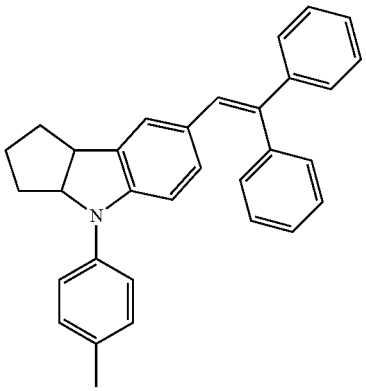

II-2

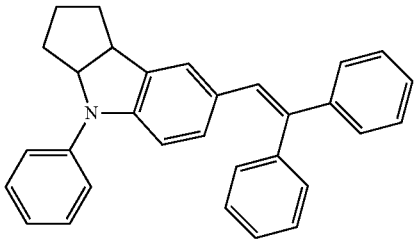

II-3

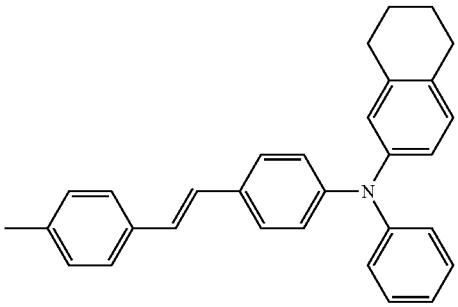

II-4

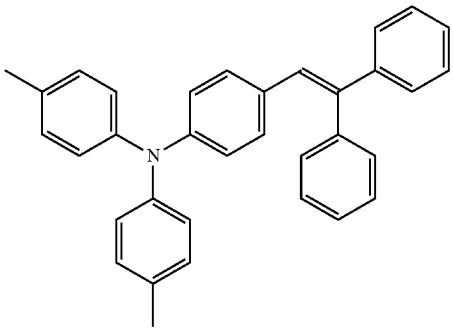

-continued

II-5

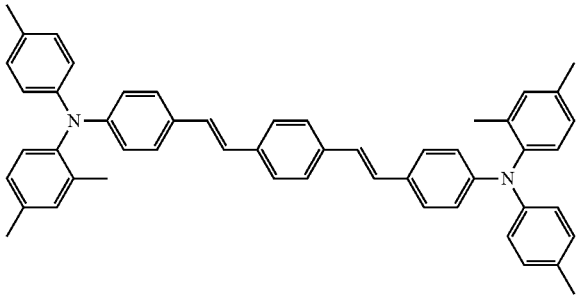

In the present invention, various additives can be used, as the case may require, in the undercoat layer 2, the charge generation layer 4 and the charge transport layer 5, for the purpose of, for instance, enhancing sensitivity, reducing residual potential, and affording high durability in terms of environmental resistance, stability towards harmful light, and abrasion resistance. Additives that can be used include, for instance, compounds such as succinic anhydride, maleic anhydride, dibrome succinic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, trinitrofluorenone or the like.

Antioxidants, light stabilizers and the like can also be added to the various layers. Compounds used for such purposes include, but not limited to, for instance, chromanol derivatives such as tocopherol, as well as ether compounds, ester compounds, polyarylalkane compounds, hydroquinone derivatives, diether compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds or hindered amine compounds.

A leveling agent such as a silicone oil or fluorinated oil can be incorporated into the photoconductive layer 3 for the purpose of enhancing leveling in the formed layer and imparting further lubricity.

In the present embodiment, the surface protective layer 6 can be further provided, as the case may require, on the surface of the photoconductive layer 3, in order to further enhance environmental resistance and mechanical strength. Preferably, the surface protective layer 6 is made up of a material having excellent environmental resistance and durability towards mechanical stress, and has the ability of transmitting, with the lowest loss possible, light to which the charge generation layer is sensitive.

The surface protective layer 6 comprises a layer having a resin binder as a main component, and/or an inorganic thin film such as amorphous carbon. For the purpose of, for instance, enhancing conductivity, lowering the coefficient of friction, and imparting lubricity, the resin binder may contain a metal oxide such as silicon oxide (silica), titanium oxide, zinc oxide, calcium oxide, aluminum oxide (alumina), zirconium oxide or the like, a metal sulfate such as barium sulfate, calcium sulfate or the like, a metal nitride such as silicon nitride, aluminum nitride or the like, microparticles of a metal oxide, or fluororesin particles of tetrafluoroethylene resins, or particles of fluorine-based comb-type graft polymerization resins. The surface protective layer 6 may contain a charge transport substance and/or electron acceptor substance that is used in the photoconductive layer, for the purpose of imparting charge transport properties, and may contain a leveling agent such as a silicone oil or a fluorinated oil for the purpose of enhancing the leveling of the formed layer and imparting lubricity. The thickness of the surface protective layer 6 itself depends on the blending composition of the protective layer, and can be arbitrarily set, so long as no adverse effects are elicited thereby, for instance increased residual potential upon repeated and continued use.

The method for producing an electrophotographic photoconductor of the present invention may include a step of forming a photoconductive layer through application, onto a conductive substrate, of a coating solution that contains at least a phthalocyanine compound as a charge generation material and that contains, as a resin binder, a polyvinyl acetal resin composed of a repeating unit represented by formula (1). In the present invention, various coating methods, for instance dip coating, spray coating or the like may be used for the coating solution. The invention is not limited to any coating method.

The electrophotographic photoconductor of the present invention affords the above-described effect by being used in various machine processes. Specifically, sufficient effects can be elicited in a charging process, for instance, a contact charging scheme relying on rollers or brushes, a contact-less charging scheme relying on a corotron, scorotron or the like, and in a development process, for instance contact development and contact-less development schemes that rely on non-magnetic single-component development, magnetic single-component development, and two-component development.

Figure 2:
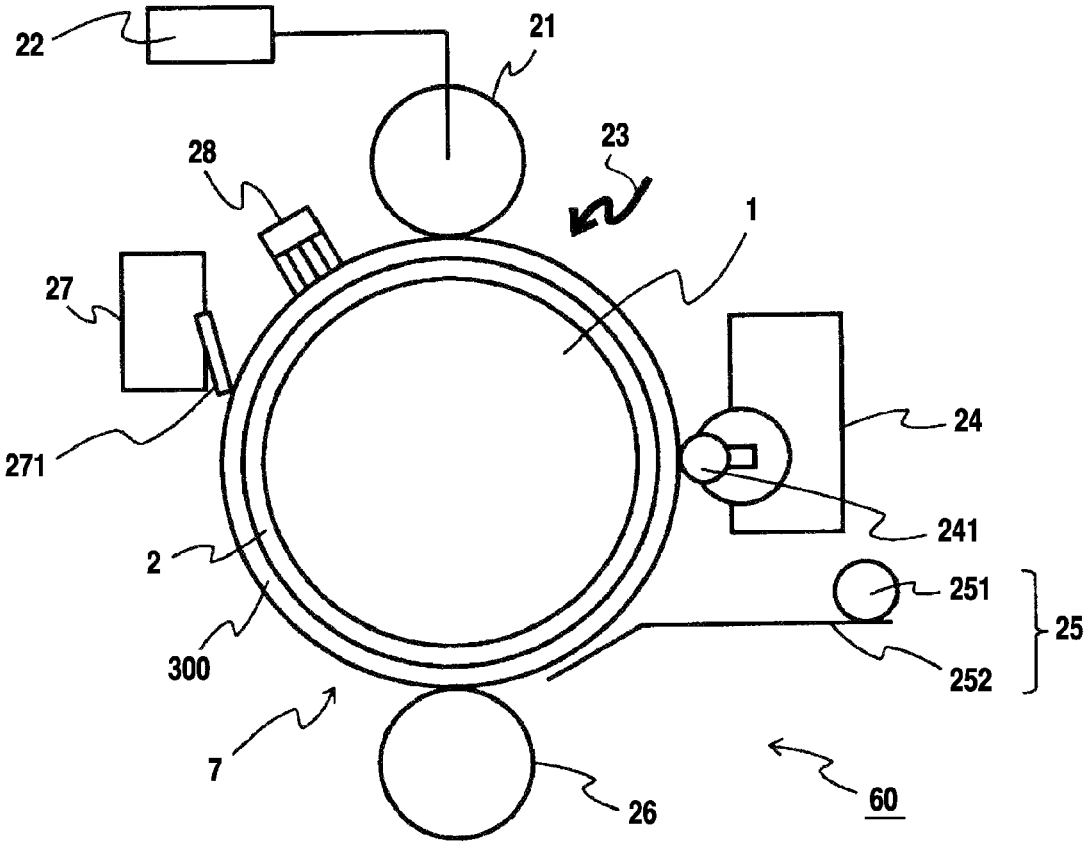
FIG. 2 is a schematic configuration diagram of one example of an electrophotographic device according to the present invention.

As an example, FIG. 2 illustrates a schematic configuration diagram of an electrophotographic device according to the present invention. The electrophotographic device 60 of the figure is equipped with an electrophotographic photoconductor 7 of the present invention, comprising a conductive substrate 1, an undercoat layer 2 that covers the outer peripheral face of the conductive substrate 1, and a photoconductive layer 300. The electrophotographic device 60 is further provided with: a roller charging member 21 that is disposed on the outer peripheral edge of the photoconductor 7; a high voltage power source 22 that supplies applied voltage to the roller charging member 21; an image exposure member 23; a developing device 24 comprising a developing roller 241; a paper feed member 25 comprising a paper feed roller 251 and a paper feed guide 252; a transfer charger (of direct charging type) 26; a cleaning device 27 comprising a cleaning blade 271; and a charge removing member 28. The electrophotographic device 60 can be used as a color printer.

EXAMPLES

The present invention will be explained next based on examples, but embodiments of the present invention are not limited to the below-described examples.

Example 1

Herein, 100 parts by mass of a polyamide resin disclosed in Japanese Patent Application Publication No. 2007-178660 or in Example 1 in U.S. Pat. No. 7,723,000, as a material of an undercoat layer, were dissolved in a mixed solvent comprising 1500 parts by mass of methanol and 500 parts by mass of butanol, followed by addition of 400 parts by mass of titanium oxide resulting from treating micro-particulate titanium oxide JMT150, by Tayca, with a 1/1 mixture of an aminosilane-based coupling agent and an isobutylsilane coupling agent, to produce a slurry. This slurry was subjected to a treatment over 20 passes, using a disk-type bead mill packed with zirconia beads having a bead diameter of 0.3 mm, at a bulk packing ratio of 70 v/v % with respect to the vessel volume, at a treatment liquid flow of 400 mL, and at a disk peripheral speed of 3 m/s, to yield an undercoat layer coating solution.

An undercoat layer was formed, through dip coating, on a cylindrical aluminum base, using the undercoat layer coating solution produced above. The undercoat layer obtained through drying under conditions of drying temperature 120° C. and drying time 30 minutes had a thickness after drying of 3 μm.

Next, 5250 g of tetrahydrofuran (by Wako Pure Chemical Industries), 251 g of polyvinyl alcohol (by Kuraray) and 90 g of 36% hydrochloric acid (by Kanto Chemical) were added to a reactor, with stirring. The reactor was set in an ice bath with 5 kg of ice water, and it was checked that the temperature of the reaction solution was not higher than 15° C. Next, 115 g of phenyl propionaldehyde (by Tokyo Chemical Industry), 129 g of butyraldehyde (by Tokyo Chemical Industry) and 78 g of 36% hydrochloric acid were sequentially dripped, with stirring. Dripping was followed by heating up to 50° C. over 0.5 hours. This temperature was held thereafter and the reaction was left to proceed for 2 hours under stirring.

Then, 2750 g of tetrahydrofuran were added to the reaction solution, the solution was retrieved from the reactor, and was then added slowly to 120 L of ion-exchanged water, under stirring. The precipitated polymer was retrieved, was transferred to a container holding an appropriate amount of ion-exchanged water, and the polymer was cured through immersion. Next, the cured polymer was crushed and was dried with hot air. A 5 wt % tetrahydrofuran solution was prepared out of this polymer, and the polymer solution was then added slowly, under stirring, to about 5-fold volume of methanol (by Kanto Chemical). The precipitated polymer was retrieved, was transferred to a container holding an appropriate amount of ion-exchanged water, and the polymer was cured through immersion. Next, the cured polymer was crushed and was dried with hot air. There were obtained 334 g of the resin of composition I-1 in Table 1 below.

Figure 3:
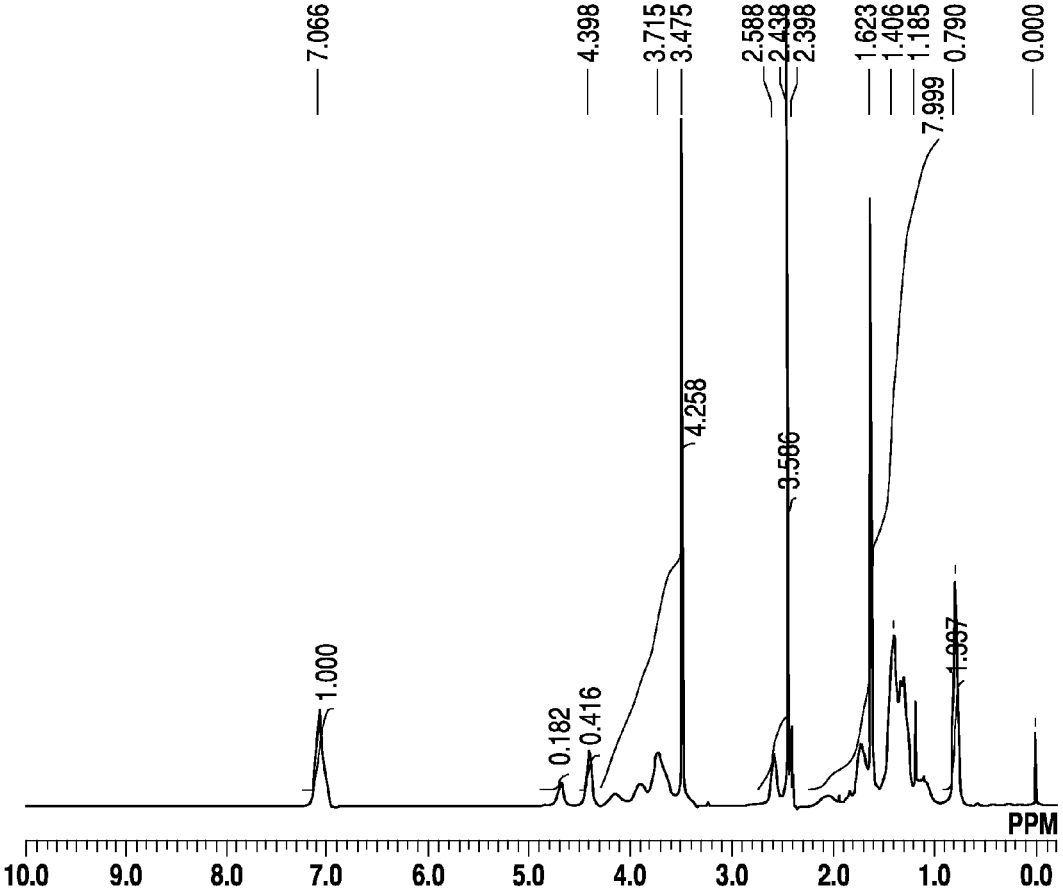
FIG. 3 is an NMR spectrum chart of a resin represented by formula (1-1) in Example 1.

The structure of the obtained compound was checked based on mechanical analysis such as NMR spectrometry, mass spectrometry and infrared spectrometry. FIG. 3 illustrates an NMR spectrum chart of the compound.

Next, 5 L of a slurry obtained by mixing 2 parts by mass of the Y-type oxotitanyl phthalocyanine compound disclosed in Japanese Patent Application Publication No. H8-209023, as a charge generation material, and 2 parts by mass of the polyvinyl acetal resin of composition I-1, as a resin binder, with 96 parts by mass of dichloromethane, was treated over 10 passes, using a disk-type bead mill packed with zirconia beads having a bead diameter of 0.4 mm, at a bulk packing ratio of 85 v/v % with respect to the vessel volume, at a treatment liquid flow of 300 mL, and at a disk peripheral speed of 3 m/s, to produce a charge generation layer coating solution.

A charge generation layer was formed, using the obtained charge generation layer coating solution, on a base having been coated with the abovementioned undercoat layer. The charge generation layer obtained through drying under conditions of drying temperature 80° C. and drying time 30 minutes had a thickness after drying of 0.3 μm.

On top of the charge generation layer a film was formed through dip-coating of a coating solution that was prepared by dissolving 10 parts by mass of the compound represented by structural formula II-1 above, as a charge transport material, and 10 parts by mass of a bisphenol Z-type polycarbonate resin (Yupitaze PCZ-500, by Mitsubishi Gas Chemical), as a resin binder, in 90 parts by mass of dichloromethane, with subsequent addition of 0.1 parts by mass of a silicone oil (KP-340, by Shin-Etsu Polymer). This was followed by drying for 60 minutes at a temperature of 90° C., to form thereby a 25 μm-charge transport layer, and produce an electrophotographic photoconductor.

Example 2

A photoconductor was produced in the same way as in Example 1, but using herein a resin of composition I-2 given in Table 1 as the resin binder of the charge generation layer.

Example 3

A photoconductor was produced in the same way as in Example 1, but using herein a resin of composition I-3 given in Table 1 as the resin binder of the charge generation layer.

Example 4

A photoconductor was produced in the same way as in Example 1, but using herein a resin of composition I-4 given in Table 1 as the resin binder of the charge generation layer.

Example 5

A photoconductor was produced in the same way as in Example 1, but using herein a resin of composition I-5 given in Table 1 as the resin binder of the charge generation layer.

Example 6

A photoconductor was produced in the same way as in Example 1, but using herein a resin of composition I-6 given in Table 1 as the resin binder of the charge generation layer.

Example 7

A photoconductor was produced in the same way as in Example 1, but using herein a resin of composition I-7 given in Table 1 as the resin binder of the charge generation layer.

Example 8

A photoconductor was produced in the same way as in Example 1, but using herein a resin of composition I-8 given in Table 1 as the resin binder of the charge generation layer.

Example 9

A photoconductor was produced in the same way as in Example 1, but using herein a resin of composition I-9 given in Table 1 as the resin binder of the charge generation layer.

Example 10

A photoconductor was produced in the same way as in Example 1, but using herein a resin of composition I-10 given in Table 1 as the resin binder of the charge generation layer.

Example 11

Herein, 2.5 parts by mass of a styrene resin (Maruka Lyncur MH2, by Maruzen Petrochemical) having a repeating unit comprising a hydroxyl group, as in structural formula (2) below, and 2.5 parts by mass of a melamine resin (Uvan 2021 resin solution, by Mitsui Chemicals), were dissolved in a solvent comprising 75 parts by mass of tetrahydrofuran and 15 parts by mass of butanol, followed by addition of 5 parts by mass of aminosilane-treated titanium oxide microparticles, to produce a slurry. This slurry was subjected to a treatment over 20 passes, using a disk-type bead mill packed with zirconia beads having a bead diameter of 0.3 mm, at a bulk packing ratio of 70 v/v % with respect to the vessel volume, at a treatment liquid flow of 400 mL, and at a disk peripheral speed of 3 m/s, to yield an undercoat layer coating solution. A photoconductor was then produced in the same way as in Example 1, but using herein the above coating solution as the undercoat layer coating solution.

(2)

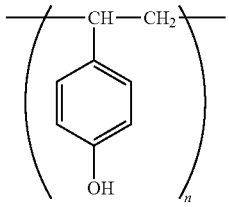

Example 12

A photoconductor was produced in the same way as in Example 1, but herein the α-type titanyl phthalocyanine disclosed in the specification of Japanese Patent Application Publication No. S61-217050 or U.S. Pat. No. 4,728,592 was used instead of Y-type oxotitanyl phthalocyanine, as the charge generation material.

Example 13

A photoconductor was produced in the same way as in Example 1, but using herein X-type metal-free phthalocyanine (Fastogen Blue 8120B, by Dainippon Ink & Chemicals), instead of Y-type titanyl phthalocyanine, as the charge generation material.

Example 14

A photoconductor was produced in the same way as in Example 1, but using herein, as the resin binder of the charge generation layer, 5 mass % of a vinyl chloride-based copolymer resin (MR110, by Zeon Corporation) with respect to the total resin in the charge generation layer.

Example 15

A photoconductor was produced in the same way as in Example 1, but using herein, as the resin binder of the charge generation layer, 1 mass % of a vinyl chloride-based copolymer resin (MR110, by Zeon Corporation) with respect to the total resin in the charge generation layer.

Example 16

A photoconductor was produced in the same way as in Example 1, but using herein a resin of composition I-11 given in Table 1 as the resin binder of the charge generation layer.

Example 17

A photoconductor was produced in the same way as in Example 1, but using herein a resin of composition I-12 given in Table 1 as the resin binder of the charge generation layer.

Example 18

A photoconductor was produced in the same way as in Example 1, but using herein a resin of composition I-13 given in Table 1 as the resin binder of the charge generation layer.

Comparative Example 1

A photoconductor was produced in the same way as in Example 1, but using herein a polyvinyl butyral resin (BM-1, by Sekisui Chemical), as the resin binder of the charge generation layer.

Comparative Example 2

A photoconductor was produced in the same way as in Example 1, but using herein a polyvinyl butyral resin (BM-S, by Sekisui Chemical), as the resin binder of the charge generation layer.

Comparative Example 3

A photoconductor was produced in the same way as in Example 1, but using herein a resin of composition I-14 given in Table 1 as the resin binder of the charge generation layer.

Comparative Example 4

A photoconductor was produced in the same way as in Example 1, but using herein a resin of composition I-15 given in Table 1 as the resin binder of the charge generation layer.

Comparative Example 5

A photoconductor was produced in the same way as in Example 1, but using herein a resin of composition I-16 given in Table 1 as the resin binder of the charge generation layer.

Comparative Example 6

A photoconductor was produced in the same way as in Example 1, but using herein a resin of composition I-17 given in Table 1 as the resin binder of the charge generation layer.

Comparative Example 7

A photoconductor was produced in the same way as in Example 1, but using herein a resin of composition I-18 given in Table 1 as the resin binder of the charge generation layer.

Comparative Example 8

A photoconductor was produced in the same way as in Example 1, but using herein a resin of composition I-19 given in Table 1 as the resin binder of the charge generation layer.

Comparative Example 9

A photoconductor was produced in the same way as in Example 1, but using herein a resin of composition I-20 given in Table 1 as the resin binder of the charge generation layer.

TABLE 1

| | | Charge generation layer resin | | | | | |
|---|---|---|---|---|---|---|---|
| | Charge generation material | No. | R | n | Degree of acetalization (x + z) | x (mol %) | z (mol %) |
| Example 1 | Y-TiOPc | I-1 | $C_3H_7$ | 2 | 89 | 71 | 29 |
| Example 2 | Y-TiOPc | I-2 | H | 2 | 90 | 69 | 31 |
| Example 3 | Y-TiOPc | I-3 | $CH_3$ | 2 | 89 | 70 | 30 |
| Example 4 | Y-TiOPc | I-4 | $C_2H_5$ | 2 | 90 | 70 | 30 |
| Example 5 | Y-TiOPc | I-5 | $C_3H_7$ | 1 | 88 | 71 | 29 |
| Example 6 | Y-TiOPc | I-6 | H | 1 | 90 | 70 | 30 |
| Example 7 | Y-TiOPc | I-7 | $CH_3$ | 1 | 89 | 70 | 30 |
| Example 8 | Y-TiOPc | I-8 | $C_2H_5$ | 1 | 90 | 70 | 30 |
| Example 9 | Y-TiOPc | I-9 | $C_3H_7$ | 2 | 90 | 51 | 49 |
| Example 10 | Y-TiOPc | I-10 | $C_3H_7$ | 2 | 90 | 94 | 6 |
| Example 11 | Y-TiOPc | I-1 | $C_3H_7$ | 2 | 89 | 71 | 29 |
| Example 12 | α-TiOPc | I-1 | $C_3H_7$ | 2 | 89 | 71 | 29 |
| Example 13 | X-$H_2$Pc | I-1 | $C_3H_7$ | 2 | 89 | 71 | 29 |
| Example 14 | Y-TiOPc | I-1 | $C_3H_7$ | 2 | 89 | 71 | 29 |
| Example 15 | Y-TiOPc | I-1 | $C_3H_7$ | 2 | 89 | 71 | 29 |
| Example 16 | Y-TiOPc | I-11 | $C_3H_7$ | 2 | 76 | 70 | 30 |
| Example 17 | Y-TiOPc | I-12 | $C_3H_7$ | 2 | 86 | 70 | 30 |
| Example 18 | Y-TiOPc | I-13 | $C_3H_7$ | 2 | 95 | 70 | 30 |
| Comparative Example 1 | Y-TiOPc | BM-1 | — | — | — | — | — |
| Comparative Example 2 | Y-TiOPc | BM-S | — | — | — | — | — |
| Comparative Example 3 | Y-TiOPc | I-14 | $C_3H_7$ | 2 | 61 | 70 | 30 |
| Comparative Example 4 | Y-TiOPc | I-15 | $C_3H_7$ | 2 | 100 | 71 | 29 |
| Comparative Example 5 | Y-TiOPc | I-16 | $C_3H_7$ | 2 | 71 | 97 | 3 |
| Comparative Example 6 | Y-TiOPc | I-17 | $C_3H_7$ | 2 | 70 | 45 | 55 |
| Comparative Example 7 | Y-TiOPc | I-18 | $C_3H_7$ | 2 | 70 | 52 | 48 |
| Comparative Example 8 | Y-TiOPc | I-19 | $C_3H_7$ | 2 | 71 | 70 | 30 |
| Comparative Example 9 | Y-TiOPc | I-20 | $C_3H_7$ | 2 | 70 | 95 | 5 |

The structural formulas of the polyvinyl butyral resins BM-1 and BM-S used in Comparative Examples 1 and 2 are given below.

TABLE 2

| | Resin | l* | m* | n* |
|---|---|---|---|---|
| Comparative Example 1 | BM-1 | 65 ± 3 | 3 or less | 34 |
| Comparative Example 2 | BM-S | 73 ± 3 | 4 to 6 | 22 |

*in the table, l, m and n denote mol % of the respective structural units in the formula below.

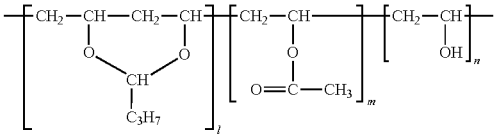

The electrophotographic electric characteristics of the photoconductors obtained in the examples and comparative examples were evaluated in accordance with the method described below, using a process simulator (CYNTHIA 91) by Gen-Tech. Firstly, the photoconductor surface was charged to −800 V through corona discharge in the dark by a scorotron charge device, and thereafter the surface potential V0 immediately after charging was measured. Next, charging was discontinued, each photoconductor was left to stand in the dark for 5 seconds, the surface potential V5 was measured, and a potential retention rate Vk5(%) after 5 seconds from charging was worked out in accordance with expression (i) below.

$$Vk5=(V5/V0)\times 100 \quad \text{(i)}$$

With a halogen lamp as a light source, exposure light resolved to 780 nm using a filter was irradiated next onto the photoconductor for 5 seconds, from the point in time at which the surface potential reached −800 V, and the exposure amount required for optical attenuation to −100 V was worked out as sensitivity E100 ($\mu Jcm^{-2}$).

Next, the photoconductors obtained in the examples and comparative examples were set in a monochrome printer mL-2241 (by Samsung Electronics) remodeled so as to enable measurement of the surface potential of a photoconductor. As an initial evaluation, there were evaluated the potential after exposure and image memory after printing of three solid white sheets and three solid black sheets under various environments (LL (low-temperature, low-humidity): 10° C. and 15% RH; NN (normal temperature, normal humidity): 25° C. and 50% RH; and HH (high-temperature, high-humidity): 35° C. and 85% RH). Acceptability in the potential evaluation was determined on the basis of the potential variation amount (LL to HH) after exposure under the various environments. Image memory evaluation involved reading a memory phenomena wherein, upon printing evaluation of an image sample imparted with a checkered flag pattern on a first-half portion and with a halftone on a second-half portion, the checkered flag becomes reflected on the halftone portion. Acceptability was determined on the basis of the intensity of the checkered flag (⊗ : very good, O: good, Δ: light memory, x: heavy memory). The variation amount of charging surface potential and image memory, before and after printing of 10,000 sheets in a normal temperature, normal humidity environment, were also evaluated.

Figure 4:
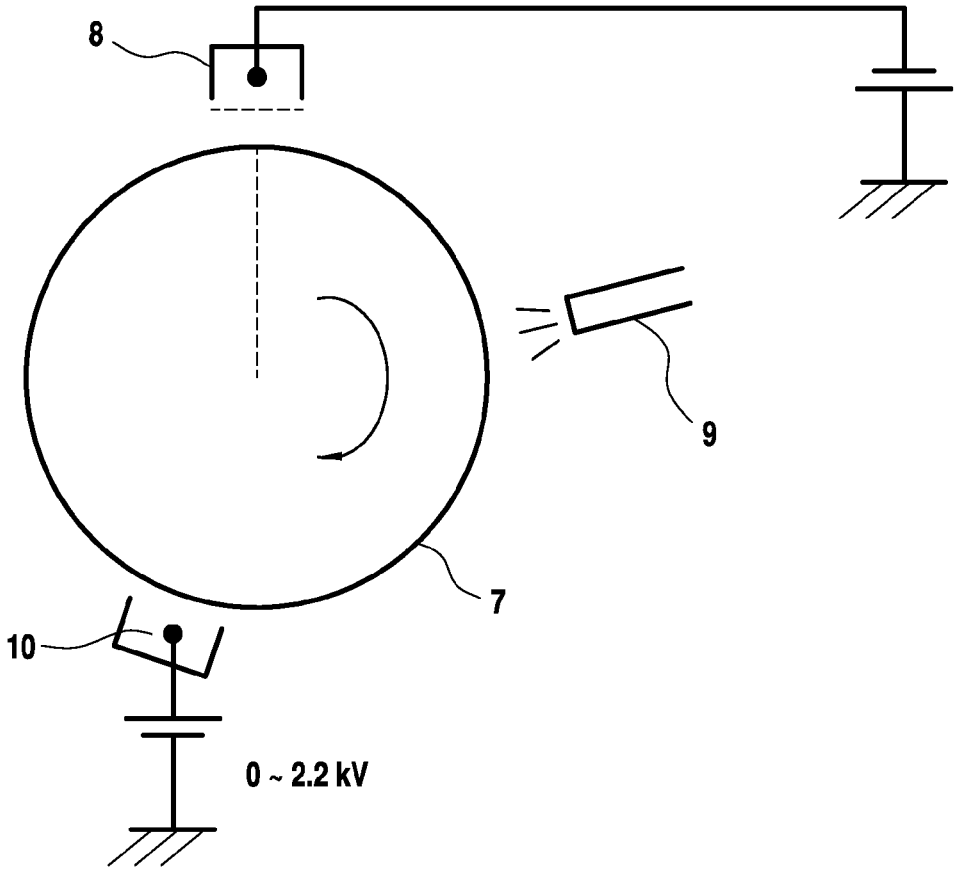
FIG. 4 is a schematic explanatory diagram illustrating a printer that is used for evaluating transfer resistance in examples.

For transfer resistance, seven solid white sheets were printed using a commercially available multi-function printer (1600n, by Dell) illustrated in FIG. 4 remodeled so as to enable observation of the surface potential of a photoconductor, with 0 kV (first sheet), and 1.2 kV (second sheet) to 2.2 kV (seventh sheet) being applied step-wise to a transfer pole 10 by a high-voltage power source, under constant-voltage control. The above printing was carried out under various environments (LL (low-temperature, low-humidity): 10° C. and 15% RH and NN (normal temperature, normal humidity): 25° C. and 50% RH), and acceptability relating to transfer resistance was determined to be good for a small ΔV, where ΔV=V1 (dark area potential between sheets for first sheet)−V7 (dark area potential for seventh sheet). In FIG. 4, the reference symbol 8 denotes a charger and the reference symbol 9 denotes an exposure light source.

To evaluate dispersion stability of the coating solution, the charge generation layer coating solutions produced in the examples and comparative examples were left to stand, sealed within transparent glass bottles, in a normal temperature, normal humidity environment (25° C. and 50% RH). The presence or absence of partial flocculation, sedimentation, separation and so forth in the coating solutions was observed visually, and acceptability was evaluated (⊗ : very good; O: good, virtually no observable separation, flocculation or sedimentation; Δ to x: separation, flocculation or sedimentation observed).

The results are given in the table below.

TABLE 3

| | Electric characteristic | | Actual-equipment evaluation: LL-HH Potential variation amount after exposure (ΔV) | Printing evaluation (initial memory) 35° C. 85% (HH) | 25° C. 50% (NN) | 10° C. 15% (LL) | Printing evaluation (after printing of 10,000 sheets) (25° C. 50%(NN)) Memory | ΔV0 (V) | Transfer resistance (ΔV) 25° C. 50% (NN) | 10° C. 15% (LL) | Coating solution stability |
|---|---|---|---|---|---|---|---|---|---|---|---|
| | Vk5 (%) | E100 ($\mu Jcm^{-2}$) | | | | | | | | | |
| Example 1 | 96.1 | 0.26 | 31 | ⊗ | ⊗ | ⊗ | ⊗ | 6 | 23 | 25 | ○ |
| Example 2 | 96.5 | 0.28 | 32 | ⊗ | ⊗ | ⊗ | ○ | 8 | 26 | 28 | ○ |
| Example 3 | 96.4 | 0.27 | 34 | ⊗ | ⊗ | ⊗ | ○ | 7 | 25 | 27 | ○ |
| Example 4 | 96.3 | 0.28 | 35 | ⊗ | ⊗ | ○ | ○ | 9 | 27 | 29 | ○ |
| Example 5 | 96.8 | 0.27 | 38 | ○ | ⊗ | ○ | ⊗ | 9 | 29 | 31 | ○ |
| Example 6 | 96.5 | 0.28 | 39 | ○ | ⊗ | ○ | ○ | 8 | 30 | 32 | ○ |
| Example 7 | 96.4 | 0.27 | 43 | ○ | ○ | ○ | ○ | 7 | 32 | 34 | ○ |
| Example 8 | 96.3 | 0.28 | 41 | ○ | ○ | ○ | ○ | 9 | 31 | 33 | ○ |
| Example 9 | 96.8 | 0.27 | 29 | ⊗ | ○ | ○ | ⊗ | 8 | 29 | 33 | ○ |
| Example 10 | 96.8 | 0.27 | 31 | ⊗ | ○ | ○ | ⊗ | 8 | 34 | 38 | ○ |
| Example 11 | 95.6 | 0.26 | 39 | ○ | ⊗ | ○ | ○ | 15 | 40 | 45 | ○ |
| Example 12 | 94.9 | 0.32 | 45 | ○ | ○ | Δ | ○ | 11 | 45 | 50 | ○ |
| Example 13 | 94.1 | 0.35 | 44 | ○ | ○ | Δ | ○ | 10 | 42 | 52 | ○ |
| Example 14 | 96.2 | 0.28 | 32 | ⊗ | ⊗ | ⊗ | ○ | 10 | 29 | 30 | ⊗ |
| Example 15 | 96.1 | 0.28 | 31 | ⊗ | ⊗ | ⊗ | ○ | 10 | 29 | 30 | ⊗ |
| Example 16 | 96.5 | 0.27 | 33 | ⊗ | ⊗ | ○ | ⊗ | 8 | 30 | 38 | ⊗ |
| Example 17 | 96.4 | 0.26 | 32 | ⊗ | ⊗ | ⊗ | ⊗ | 7 | 24 | 26 | ⊗ |
| Example 18 | 96.3 | 0.26 | 31 | ⊗ | ⊗ | ⊗ | ⊗ | 7 | 24 | 25 | ⊗ |
| Comparative Example 1 | 90.2 | 0.26 | 65 | ○ | ○ | ○ | Δ | 21 | 111 | 121 | ○ |
| Comparative Example 2 | 91.6 | 0.26 | 72 | ○ | ○ | ○ | ○ | 18 | 120 | 130 | ○ |
| Comparative Example 3 | 90.4 | 0.26 | 81 | ○ | ○ | Δ | Δ | 17 | 101 | 111 | Δ |
| Comparative Example 4 | 88.2 | 0.29 | 75 | ○ | ○ | Δ | Δ | 20 | 119 | 130 | X |
| Comparative Example 5 | 88.6 | 0.29 | 91 | ○ | ○ | ○ | Δ | 23 | 130 | 142 | Δ |

TABLE 3-continued

| | Electric characteristic | | LL-HH Potential variation amount after exposure (ΔV) | Actual-equipment evaluation: Printing evaluation (initial memory) 35° C. 85% (HH) | 25° C. 50% (NN) | 10° C. 15% (LL) | Printing evaluation (after printing of 10,000 sheets) (25° C. 50%(NN)) | | Transfer resistance (ΔV) 25° C. 50% (NN) | 10° C. 15% (LL) | Coating solution stability |
|---|---|---|---|---|---|---|---|---|---|---|---|
| | Vk5 (%) | E100 ($\mu Jcm^{-2}$) | | | | | Memory | ΔV0 (V) | | | |
| Comparative Example 6 | 87.4 | 0.30 | 96 | ○ | ○ | X | Δ | 26 | 121 | 130 | X |
| Comparative Example 7 | 96.8 | 0.27 | 33 | ⊗ | ○ | ○ | ⊗ | 8 | 32 | 64 | ○ |
| Comparative Example 8 | 96.8 | 0.27 | 33 | ⊗ | ⊗ | ○ | ⊗ | 8 | 31 | 63 | ○ |
| Comparative Example 9 | 96.8 | 0.27 | 38 | ○ | ⊗ | ○ | ⊗ | 8 | 34 | 66 | ○ |

The results of Examples 1 to 18 in Table 3 indicate that a photoconductor can be obtained that exhibits good initial electric characteristics, good electric characteristics and memory characteristics upon fluctuation in the usage environment, as well as good transfer resistance, by incorporating, into the charge generation layer, a specific polyvinyl acetal resin according to the present invention, having a degree of acetalization (x+z) of 76 to 99 mol % and a molar ratio x:z of the structural units of 95:5 to 50:50. It was found that transfer performance under various environments became more stable by raising the degree of acetalization so as to lie within the range of the present invention, and by lowering the ratio (y) of structural unit having highly hydrophilic hydroxyl groups. In particular, it is found that the difference in the ΔV value, which denotes transfer resistance, between an NN environment and an LL environment is smaller, and that fluctuations tend to become more stable under all environments, in those examples where there is used a resin having a degree of acetalization (x+z) of 86 mol % or higher. Photoconductors corresponding to combinations with Y-type titanyl phthalocyanine as the charge generation material exhibited higher sensitivity and higher transfer resistance. Coating solution stability was best in combinations that included 1 to 5 mass % of a vinyl chloride-based copolymer resin with respect to the total resin in the charge generation layer.

The results of Comparative Examples 1 to 9 show that a commercially available butyral resin does not afford sufficient results, and that initial electric characteristic, transfer resistance and memory characteristics are poorer when either range from among a degree of acetalization (x+z) of 76 to 99 mol % and a molar ratio x:z of the structural units of 95:5 to 50:50 fails to be satisfied. It was found that the stability of the coating solution was poor in a case where the degree of acetalization was smaller than 70 mol % or was 100 mol %, and that solubility in the solvent became significantly poor when phenyl groups were 50 mol % or more.

The above results confirmed that a photoconductor that exhibits high memory characteristics, high resolution and good electric characteristics is obtained by incorporating, into a photoconductive layer, a polyvinyl acetal resin having the specific composition and structural unit ratio according to the present invention. It was likewise found that yet more pronounced effects are achieved when a specific undercoat layer is combined into the photoconductive layer.

The invention claimed is:

1. An electrophotographic photoconductor, comprising, in the order recited:

a conductive substrate;

an undercoat layer provided on the conductive substrate; and a photoconductive layer provided on the undercoat layer and containing at least a phthalocyanine compound as a charge generation material and, as a resin binder, a polyvinyl acetal resin composed of a repeating unit represented by formula (1):

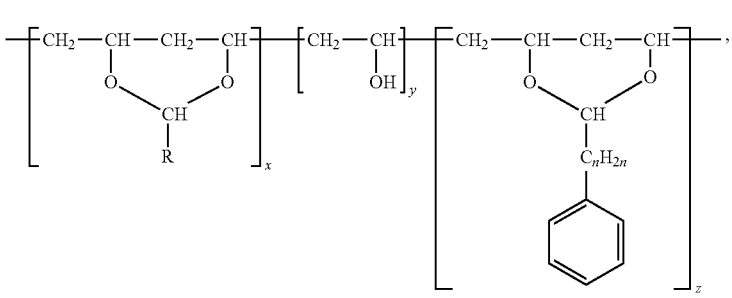

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 86 to 99 mol %; and a molar ratio (x:z) of the structural units is 95:5 to 50:50.

2. The electrophotographic photoconductor according to claim 1, wherein a polyvinyl butyral resin in which R in formula (1) is a propyl group is used as the resin binder.

3. The electrophotographic photoconductor according to claim 1, wherein the phthalocyanine compound is Y-type oxotitanyl phthalocyanine.

4. The electrophotographic photoconductor according to claim 1, wherein the undercoat layer contains a polyamide resin.

5. The electrophotographic photoconductor according to claim 1, wherein the photoconductive layer is of a multilayer type comprising a charge generation layer and a charge transport layer, and contains, as a resin binder of the charge generation layer, 1 to 5 mass % of a vinyl chloride-based copolymer resin relative to a total amount of the resin binder in the charge generation layer.

6. The electrophotographic photoconductor according to claim 1, wherein the degree of acetalization (x+z) ranges from 86 to 95 mol %.

7. An electrophotographic device equipped with the electrophotographic photoconductor according to claim 1.

8. A method for producing an electrophotographic photoconductor according to claim 1, the method comprising:

providing a conductive substrate;

providing an undercoat layer on the conductive substrate;

providing a coating solution containing at least a phthalocyanine compound as a charge generation material, and, as a resin binder, a polyvinyl acetal resin composed of a repeating unit represented by formula (1):

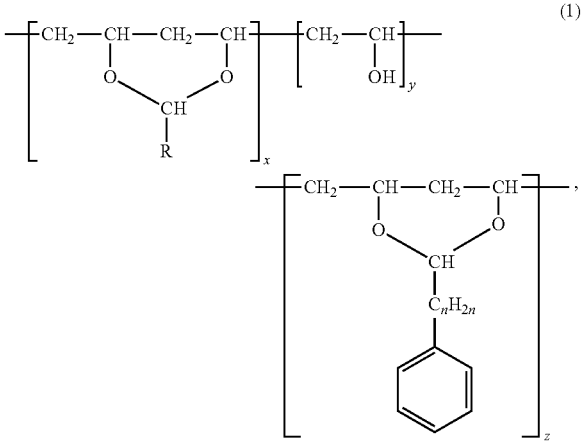

(1)

where, in formula (1), R is a hydrogen atom, a methyl group, an ethyl group or a propyl group; x, y and z represent mol % of the respective structural units, where x+y+z=100; n is an integer from 1 to 5; a degree of acetalization (x+z) is 86 to 99 mol %; and a molar ratio (x:z) of the structural units is 95:5 to 50:50; and forming a photoconductive layer by applying the coating solution onto the undercoat layer.

9. The method according to claim 8, wherein the degree of acetalization (x+z) ranges from 86 to 95 mol %.

* * * * *